US006957791B2

(12) United States Patent
Ellis

(10) Patent No.: US 6,957,791 B2
(45) Date of Patent: Oct. 25, 2005

(54) PAPER ROLL DISPENSER

(76) Inventor: Richard S. Ellis, 30 Bondgate Court, Scarborough, Ontario (CA) M1B 3A1

( * ) Notice: Subject to any disclaimer, the term of this patent is extended or adjusted under 35 U.S.C. 154(b) by 0 days.

(21) Appl. No.: 10/681,338

(22) Filed: Oct. 9, 2003

(65) Prior Publication Data

US 2005/0077312 A1 Apr. 14, 2005

(51) Int. Cl.[7] ..... B65H 19/00

(52) U.S. Cl. ..... 242/560.2; 242/560; 242/561; 242/595; 242/598.6; 312/34.22

(58) Field of Search ..... 242/560, 560.1, 242/560.2, 561, 566, 594, 596.8, 598.3, 598.5, 242/598.6, 595, 560.3; 312/242, 245, 34.1, 312/34.8, 34.22, 34.24; D6/518, 519, 520, D6/523, 575

(56) References Cited

U.S. PATENT DOCUMENTS

| | | | | | |
|---|---|---|---|---|---|
| 2,605,975 | A | * | 8/1952 | Page et al. | 242/560.3 |
| 2,872,264 | A | * | 2/1959 | Nehring | 242/560.3 |
| 2,991,951 | A | | 7/1961 | Carroll | |
| 3,039,709 | A | * | 6/1962 | Bolger | 242/560.3 |
| 3,130,932 | A | * | 4/1964 | Pena | 242/560.3 |
| 3,266,742 | A | * | 8/1966 | Pena | 242/580.3 |
| 3,295,777 | A | | 1/1967 | Carroll | |
| 3,580,651 | A | | 5/1971 | Gauper | |
| 3,754,719 | A | * | 8/1973 | Choy | 242/560.3 |
| 3,865,295 | A | * | 2/1975 | Okamura | 242/560 |
| 4,034,924 | A | * | 7/1977 | Carlisle | 242/560.3 |
| 4,135,678 | A | | 1/1979 | Williams | |
| 4,322,042 | A | | 3/1982 | Wormly | |
| 4,363,454 | A | * | 12/1982 | Mohar | 242/560.3 |
| 4,389,026 | A | * | 6/1983 | Willa et al. | 242/560.3 |
| 4,564,148 | A | | 1/1986 | Wentworth | |
| 4,607,809 | A | | 8/1986 | Sineni et al. | |
| 4,662,577 | A | * | 5/1987 | Lewis | 242/560.3 |
| 4,684,075 | A | | 8/1987 | Francis | |
| 4,697,754 | A | * | 10/1987 | Duff | 242/560.3 |
| 6,062,422 | A | | 5/2000 | Ellis | |
| 6,161,794 | A | * | 12/2000 | Cravatt | 242/580.3 |

* cited by examiner

*Primary Examiner*—William A. Rivera
(74) *Attorney, Agent, or Firm*—Ridout & Maybe LLP

(57) ABSTRACT

A paper roll dispenser comprising a tube having an open upper end through which rolls may be introduced and an open lower end through which dispensed rolls may be retrieved. The tube is adapted to hold a plurality of rolls comprising at least a lowermost roll and a roll upwardly adjacent the lowermost roll. A lever member is supported on the tube to pivot on the tube, and is pivotable between a retaining position (in which a lower end of the level engages the lowermost roll and an upper end of the lever is spaced from the upwardly adjacent roll) and a dispensing position (in which the lower end of the lever is spaced from the lowermost roll and the upper end of the lever engages the upwardly adjacent roll). Also provided is a biasing device biasing the lever from the dispensing position to the retaining position.

14 Claims, 4 Drawing Sheets

10
14
14a
18
22
26
30
34
38
42
46
50
54
58
58a
62
62a
66
66a
70
74
98
102
106
5

PAPER ROLL DISPENSER

FIELD OF THE INVENTION

This invention relates to a paper roll dispenser and more particularly to an apparatus for the household storage and dispensing of toilet paper.

BACKGROUND OF THE INVENTION

Paper rolls such as toilet paper rolls and paper towel rolls are usually purchased in packages containing multiple rolls. In order to maximize counter top space available in a household, these rolls are usually stored out of sight (e.g. in storage closets etc.). This practise is problematic particularly in the case of toilet paper rolls because a fresh toilet paper roll may not be easily available to an individual in a time of need.

Attempts to alleviate this problem include Gauper (U.S. Pat. No. 3,580,651), which provides a paper dispensing apparatus in an elongate hollow housing. However, the Gauper dispenser can damage paper rolls by the ends of the arcuate members used therein.

Wormly (U.S. Pat. No. 4,322,042) discloses a dispenser wherein paper rolls are retained in an upright container and are vertically oriented unlike in Gauper. Disadvantages with the Wormly dispenser include damage to the paper rolls resulting from the spring fingers, distortion of the shape of the paper rolls and difficulty in refilling the dispenser.

Francis (U.S. Pat. No. 4,684,075) discloses a dispenser that is difficult and expensive to manufacture because it relies on a plurality of levers and springs.

SUMMARY OF THE INVENTION

According to the present invention there is provided a paper roll dispenser comprising a tube having an open upper end through which rolls may be introduced and an open lower end through which dispensed rolls may be retrieved. The tube is adapted to hold a plurality of rolls comprising at least a lowermost roll and a roll upwardly adjacent the lowermost roll. A lever member is supported on the tube to pivot on the tube, and is pivotable between a retaining position (in which a lower end of the level engages the lowermost roll and an upper end of the lever is spaced from the upwardly adjacent roll) and a dispensing position (in which the lower end of the lever is spaced from the lowermost roll and the upper end of the lever engages the upwardly adjacent roll). Also provided is a biasing device biasing the lever from the dispensing position to the retaining position

DETAILED DESCRIPTION OF THE DRAWINGS

Figures 1, 2, 3, 4:
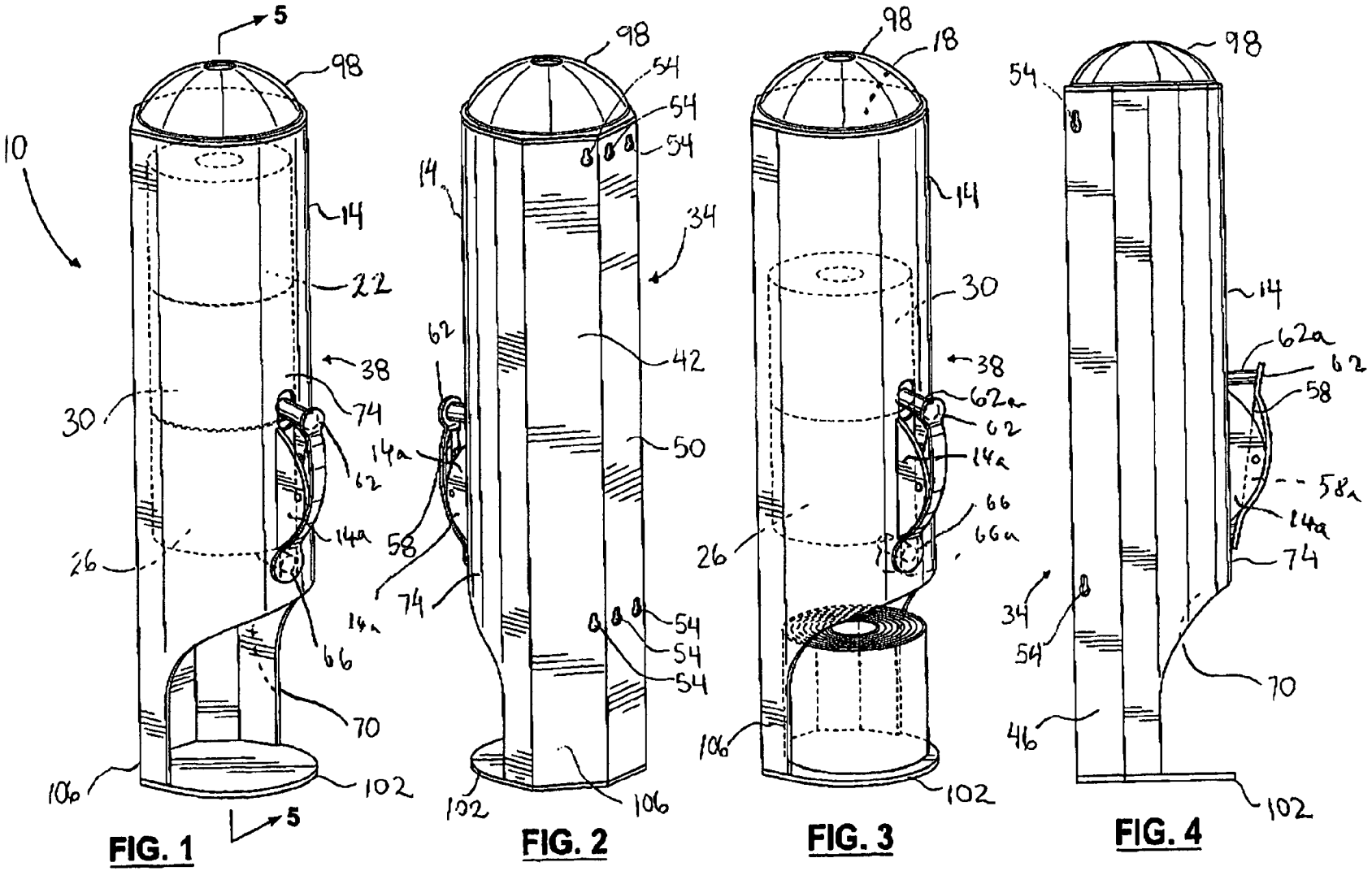
FIG. 1 is a perspective front-side view of a preferred embodiment of the paper roll dispenser.
FIG. 2 is a perspective rear-view of a preferred embodiment of the paper roll dispenser.
FIG. 3 is a perspective view similar to FIG. 1 showing a dispensed paper roll.
FIG. 4 is a side elevational view of the paper roll dispenser shown in FIG. 1.

A preferred embodiment of the present invention is shown in FIG. 1. The paper roll dispenser 10 is comprised of a tube 14 having an open upper end 18 through which rolls of paper 22 may be dispensed and retrieved.

The tube 14 holds at least a lowermost roll 26 and an upwardly adjacent roll 30, and the length of the tube can be varied to hold any number of rolls of paper 22 as desired. The dispenser 10 can be made of plastic or any other suitable material.

The tube can define a generally rearward portion 34 and a frontward portion 38. The rearward portion can optionally define two side walls 42, 46 (best seen in FIGS. 2 and 4) as well as a rear wall 50 (best seen in FIG. 2). The side walls 42, 46 extend at substantially right angles to each other, so that the dispenser 10 may be snugly seated in a right angle corner of two walls (not shown). In the alternative, the rear wall 50 permits the dispenser 10 to be positioned snugly against a single wall (not shown). The side walls 42, 46 and rear wall 50 can define a plurality of openings 54 for the passage of fasteners (not shown) therethrough, to mount the dispenser 10 either in a corner or on a single wall as required.

Figure 8:
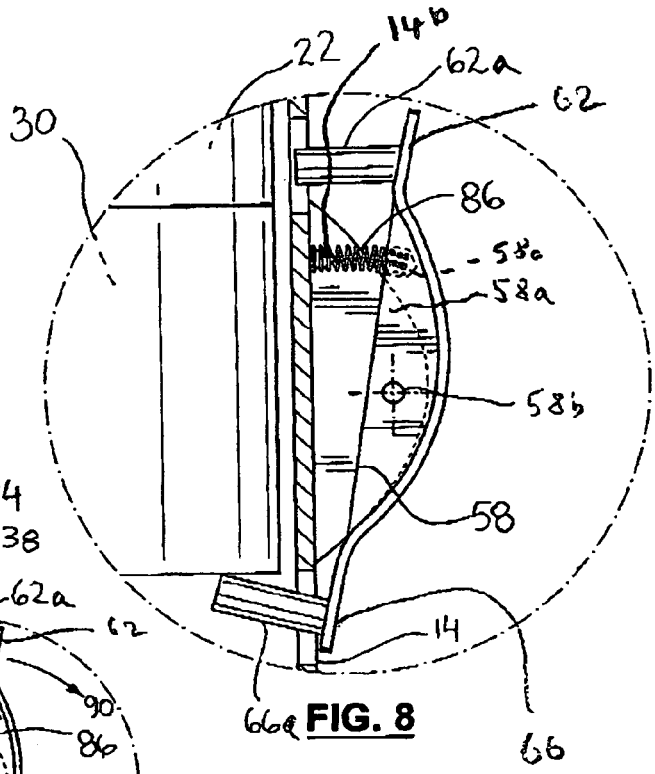
FIG. 8 is an enlargement of the circle 8 shown in FIG. 7.

The frontward portion 38 of the dispenser 10 is generally cylindrical in shape to conform to the shape of the paper rolls 22. Attached to the frontward portion 38 is a lever 58 (best seen in FIG. 8) having an upper 62 and a lower 66 end. The lever is supported on the tube 14 and can be on the inner surface 70 of the tube or on the outside surface 74 of the tub.

In the example shown, the handle 58 is of reduced width and a middle portion 58*a* is received snugly between parallel walls 14*a* extending from the tube 14, and connected thereto by a shaft 58*b* providing an axis about which the handle can pivot.

Figure 5:
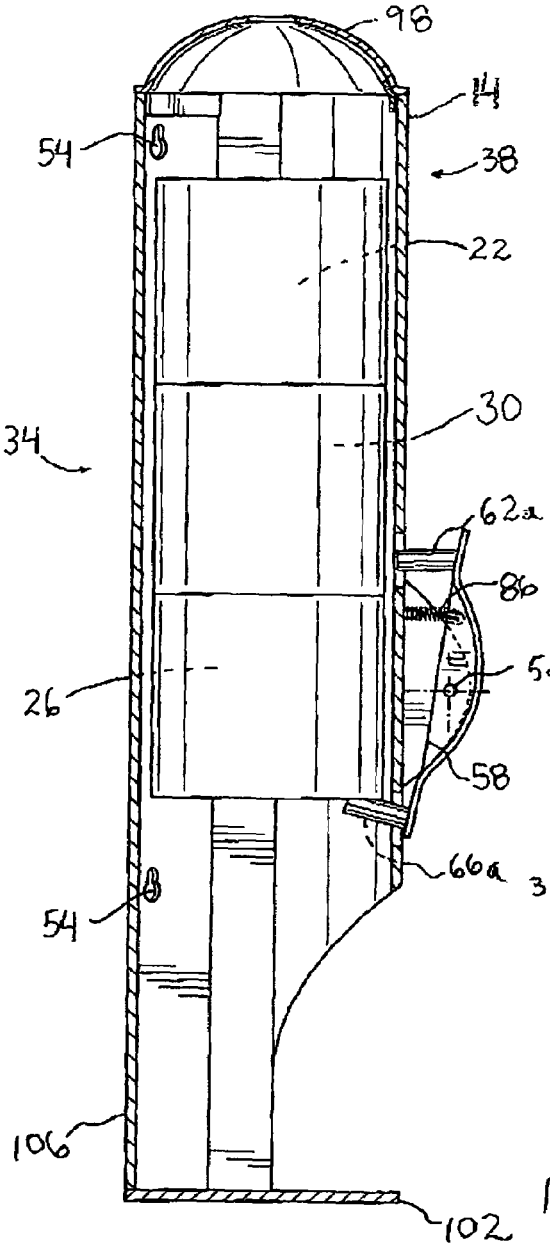
FIG. 5 is a cross-sectional view taken along the line 5—5 shown in FIG. 1 with the dispenser in the retaining position.
Figure 6:
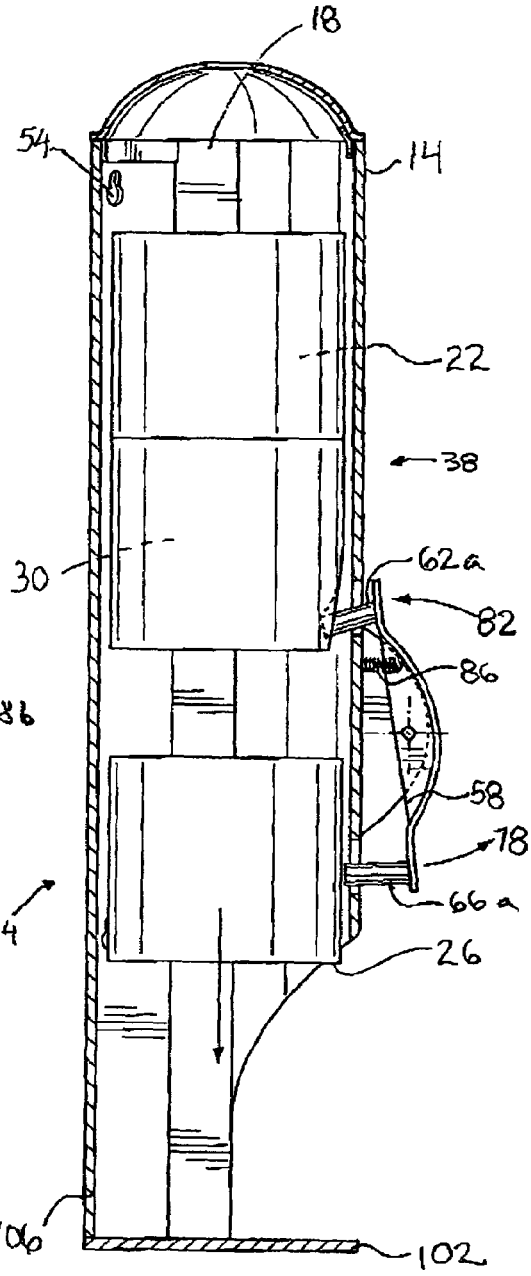
FIG. 6 is a cross-sectional view similar to FIG. 5 showing the dispenser in the dispensing position.

The lever 58 is pivotable between a retaining position (best seen in FIGS. 1 and 5) wherein the lowermost roll 26 is supported adjacent the lever lower end 66, and a dispensing position (best seen in FIG. 6) wherein the lever lower end 66 moves away from the lowermost roll 26 in the direction generally indicated by arrow 78.

In the dispensing position, the lever upper end 62 travels in the direction generally indicated by arrow 82, and a portion of the lever compressively engages the upwardly adjacent roll 30.

To permit the lever 58 to function without requiring a large pivoting angle between the retaining and dispensing positions, preferably the upper and lower ends 62 and 66 are provided with respective extensions 62*a* and 66 projecting toward the axis of the tube 14.

Figure 7:
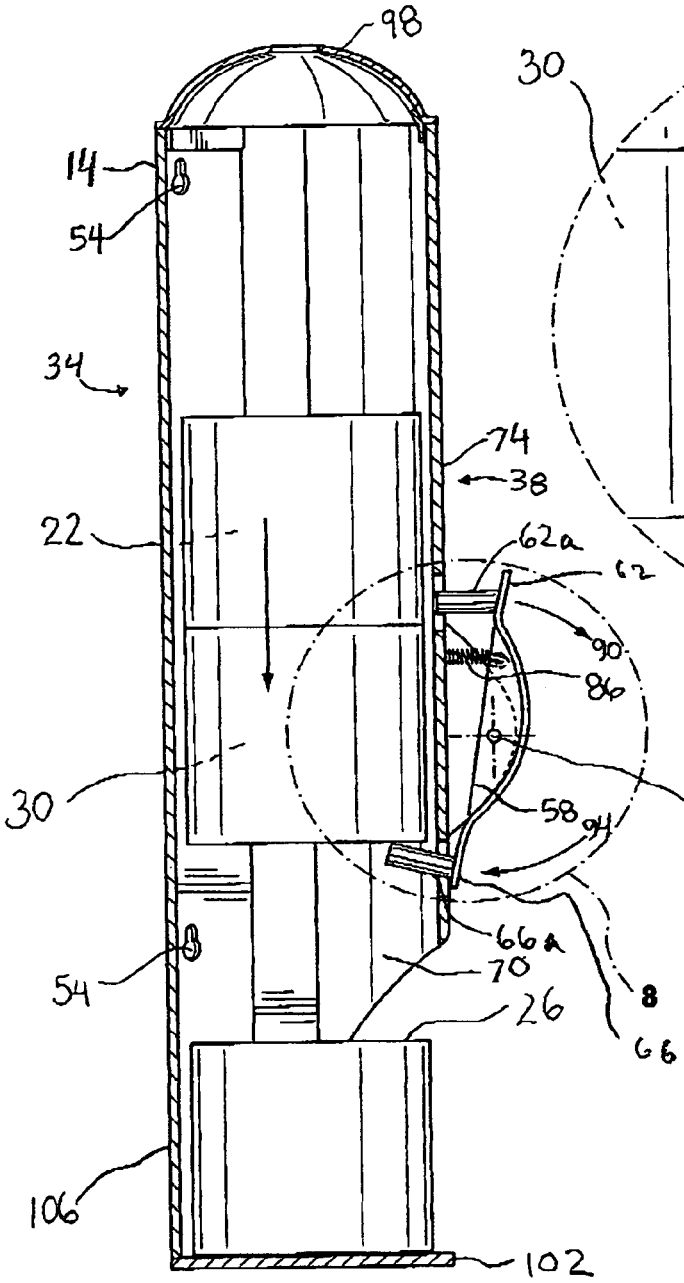
FIG. 7 is a cross-sectional view similar to FIG. 5 showing a dispensed paper roll.

To return to the retaining position, a biasing device such as a compression spring 86 biases the lever 58 so that the lever upper end 62 generally moves in the direction indicated by arrow 90 and the lever lower end 66 generally moves in the direction indicated by arrow 94 (see FIG. 7).

In the example illustrated, the compression spring 86 comprises a coil spring located at one end on a stub 14*b* connected on the front wall 38 of the tube 14 and at the other end in a bore 58*c* in the middle portion 58*a* of the handle 58.

A removable cap 98 can optionally be provided at the top of the open upper end 18. A base plate 102 can also be provided at the tube bottom end 106 to arrest the movement of the lowermost roll 26 when dispensed.

In operation, rolls of paper 22 are loaded through the tube 14 open upper end 18. The lowermost roll 26 drops to a position where it is supported by the lever lower end extension 66*a* while the lever 58 is in the retaining position.

A user presses the lever upper end 62 against the action of spring 86 into the dispensing position (FIG. 6), thereby engaging the upper extension with, and compressively retaining the upwardly adjacent roll 30. In the dispensing position, the extension 66*a* disengages the lowermost roll 26 which falls through the tube bottom portion 106 and comes to rest on the base plate 102.

When the user releases the lever upper end 62, the compression spring 86 pushes the lever back into the retaining position, in which extension 62*a* disengages and releases the upwardly adjacent roll 30. The upwardly adjacent roll 30 falls downward and comes to rest against the lever lower end extension 66*a*, and becomes the new lowermost roll 26.

Figure 9:
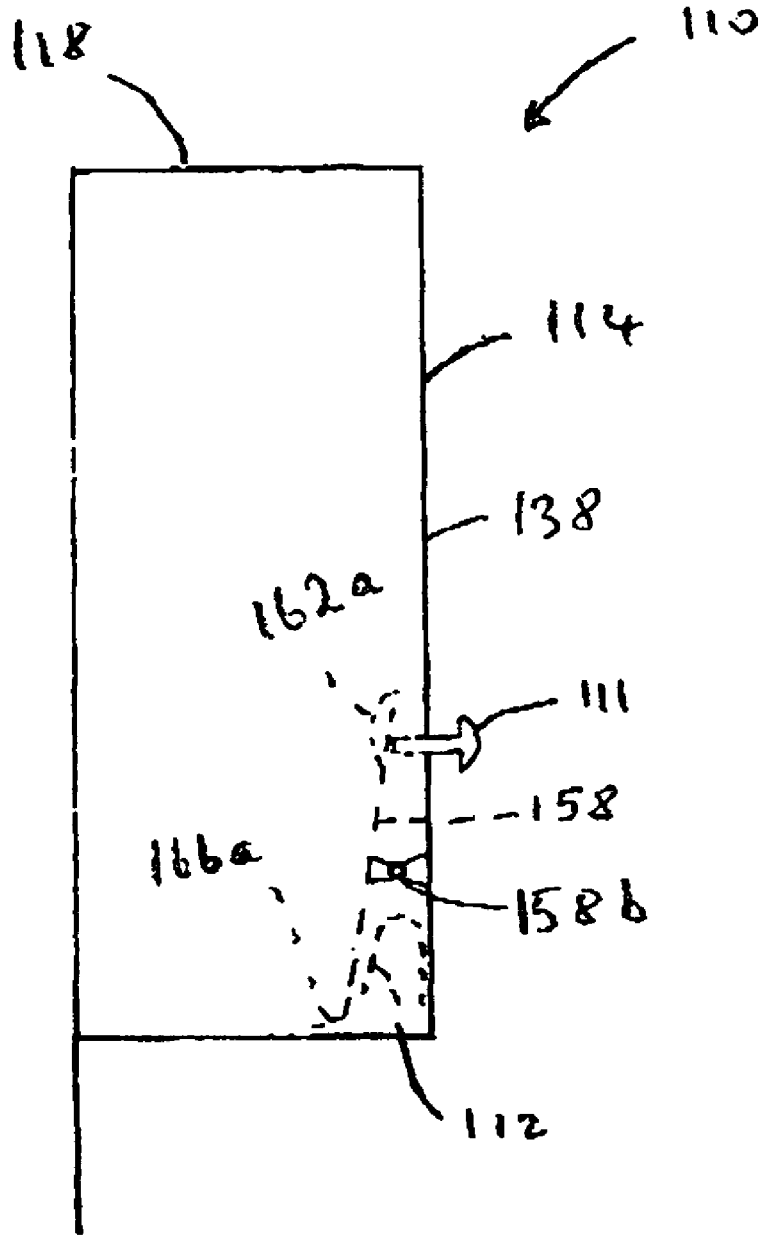
FIG. 9 is a somewhat schematic side view, partly in section, showing a further embodiment of the dispenser of the invention.

FIG. 9 shows somewhat schematically a further embodiment 110. Like parts are denoted by the same reference numerals as in FIGS. 1 to 8, raised by 100. In the example illustrated, a button actuator 111 sliding in an opening in the front wall 138 of the tube 114 can be pushed inwardly against the action of a U-shaped leaf spring 112 to move the lever from the retaining position shown in FIG. 9 to a dispensing position in which lower extension 166*a* disengages a lower side of a lowermost roll while upper extension 162*a* engages a side of a roll upwardly adjacent thereto.

What is claimed is:

1. A paper roll dispenser comprising:

a tube having an open top through which rolls may be introduced and an opening adjacent a lower end through which dispensed rolls may be retrieved, said tube holding a plurality of rolls comprising at least a lowermost roll and a roll upwardly adjacent the lowermost roll, said rolls having their axes parallel to the tube;

a lever member supported to pivot on an exterior of a side wall of the tube and pivotable by pressure applied to an upper end of the lever from a retaining position in which a lower end portion of the lever extending through a first opening in said side wall engages the lowermost roll and an upper end portion of the lever is spaced from said upwardly adjacent roll to a dispensing position in which the lower end portion of the lever is spaced from the lowermost roll and the upper end portion of the lever extending through a second opening in said side wall engages said upwardly adjacent roll; and a biasing device biasing said lever from the dispensing position toward the retaining position when said pressure is released.

2. The paper roll dispenser as defined in claim 1 wherein the biasing device is a compression spring.

3. The paper roll dispenser as defined in claim 1 wherein the lower end of the lever has an extension extending inwardly toward the axis of the tube, said extension engaging the lowermost roll in the retaining position.

4. The paper roll dispenser as defined in claim 1 wherein the upper end of the lever has an upper end extension extending inwardly toward the axis of the tube, said upper end extension engaging said upwardly adjacent roll in the dispensing position.

5. The paper roll dispenser as defined in claim 1 wherein the tube has a length equivalent to at least three times a length of one of the rolls of paper.

6. The paper roll dispenser as defined in claim 1 further comprising a removable cap attached to the open top.

7. The paper roll dispenser as defined in claim 1 wherein the tube is at least partially cylindrical in shape.

8. The paper roll dispenser as defined in claim 1 wherein the tube is at least partially polygonal in shape.

9. The paper roll dispenser as defined in claim 1 wherein the dispenser defines a rearward and a frontward portion.

10. The paper roll dispenser as defined in claim 9 wherein the rearward portion further defines two side walls, the side walls extending at substantially right angles to each other.

11. The paper roll dispenser as defined in claim 9 wherein the frontward portion is cylindrical in shape.

12. The paper roll dispenser as defined in claim 1 further comprising a base plate attached to the tube lower end, to arrest the movement of the lowermost roll when dispensed.

13. The paper roll dispenser as defined in claim 1 wherein the dispenser is made of a plastic material.

14. The paper roll dispenser as defined in claim 13 wherein the plastic material is acrylic.

* * * * *